United States Patent [19]

Lipkin et al.

[11] Patent Number: 4,954,247

[45] Date of Patent: Sep. 4, 1990

[54] PROCESS FOR SEPARATING HYDROCARBONS

[75] Inventors: Gregory M. Lipkin, Secaucus; Joseph L. Niedzwiecki, Fanwood, boht of N.J.

[73] Assignee: Exxon Research and Engineering Company, Florham Park, N.J.

[21] Appl. No.: 258,531

[22] Filed: Oct. 17, 1988

[51] Int. Cl.[5] ..... C10G 7/06

[52] U.S. Cl. ..... 208/355; 208/356; 208/357

[58] Field of Search ..... 208/354, 355, 356, 357

[56] References Cited

U.S. PATENT DOCUMENTS

| | | | |
|---|---|---|---|
| 2,073,622 | 3/1937 | Brandt | 196/140 |
| 2,096,700 | 10/1937 | Smith | 208/354 |
| 2,160,256 | 5/1939 | Aldridge et al. | 196/71 |
| 2,341,389 | 2/1944 | Rupp et al. | 196/11 |
| 2,736,688 | 2/1956 | Kraft | 208/355 |
| 2,900,327 | 8/1959 | Beuther | 208/355 |
| 2,900,327 | 8/1959 | Beuther et al. | 208/106 |
| 4,082,653 | 4/1978 | DeGraff | 208/354 |
| 4,239,618 | 12/1980 | Peiser et al. | 208/355 |
| 4,606,816 | 8/1986 | Harandi | 208/354 |
| 4,662,995 | 5/1987 | Lipkin et al. | 203/98 |

*Primary Examiner*—Asok Pal

*Attorney, Agent, or Firm*—Roy J. Ott

[57] ABSTRACT

A process for improving the separation of a hydrocarbonaceous oil is provided, in which the oil is separated into fractions in an atmospheric distillation zone. The heavy bottoms fraction (atmospheric residuum) is split into two streams. One stream is passed through a heating zone and, subsequently, to a vacuum separation zone. The other stream by-passes the heating zone and is introduced directly into the vacuum separation zone.

10 Claims, 1 Drawing Sheet

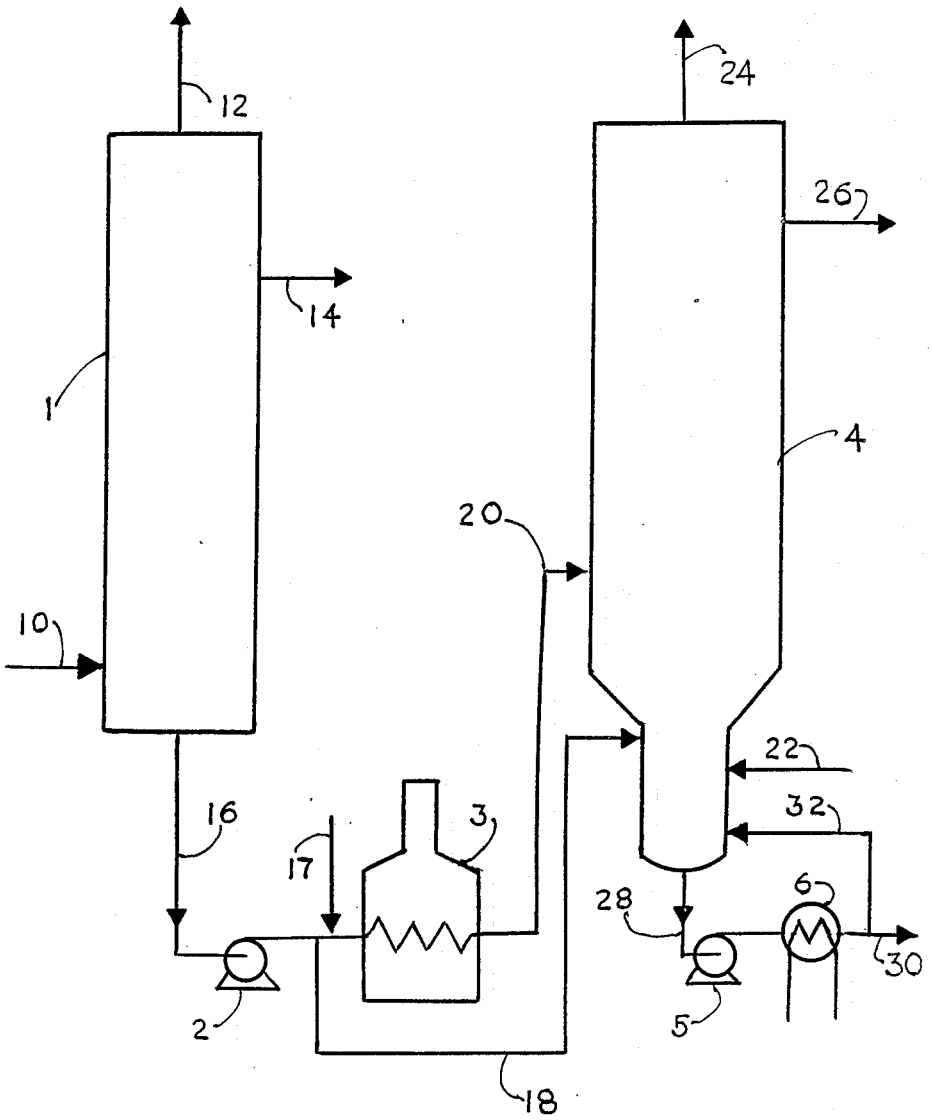
12
24
26
14
1
4
20
10
22
32
16
3
17
6
28
30
2
5
18

PROCESS FOR SEPARATING HYDROCARBONS

BACKGROUND OF THE INVENTION

1. Field of the Invention

This invention relates to an improved process for separating hydrocarbons into fractions having different boiling points. More particularly, this invention relates to an improvement in a distillation process.

2. Description of Information Disclosures

Processes are known for separating mixtures of hydrocarbons into fractions having different boiling point ranges by subjecting the hydrocarbon mixture to a distillation zone to produce a vapor phase fraction, one or a plurality of liquid sidestreams, and a heavy bottoms fraction. It is also known to separate under vacuum the heavy bottoms fraction into additional fractions.

U.S. Pat. No. 2,073,622 discloses a process for cracking hydrocarbonaceous oils. The bottoms from a cracking chamber are withdrawn through a pipe and a pump. A portion of the bottoms is passed through a furnace to the top of a separator. When a valve is open, an other portion of the bottoms passes into the bottom of the separator.

U.S. Pat. No. 2,900,327 discloses removing bottoms from a fractionator in two separate streams. One stream is passed through a furnace. The other stream by-passes the furnace and is introduced into a stream which leaves the furnace. The combined stream enters a separator.

U.S. Pat. No. 2,160,256 discloses a caustic stream in line 112. One portion of the stream passes through a heater. An other portion of the stream by-passes the heater.

U.S. Pat. No. 2,341,389 discloses a process for fractionating light hydrocarbon oils comprising two fractionators with an intermediate furnace.

U.S. Pat. No. 4,662,995 discloses a method and apparatus for separating hydrocarbon mixtures by distillation, steam stripping a sidestream, returning a vapor separated in the sidestream stripper to the distillation zone at a location at least two trays and/or at least one theoretical stage above the liquid draw-off from the distillation zone to the sidestream stripping zone.

Although some of these processes increase the amount of lower boiling components that can be separated from the heavier fractions, there is still a need to improve the separation of lower components from the higher components.

It has now been found that the amount of lower boiling components that can be separated from the higher boiling components can be increased, in a hydrocarbon separation process, in which the heavy bottoms fraction of an atmospheric distillation zone is heated in a heating zone, such as a furnace, and subsequently passed to a vacuum separation zone, if a portion of the heavy bottoms fraction by-passes the heating zone and is introduced directly into the vacuum separation zone. This permits the total feed rate of the heavy bottoms portion to the vacuum separating zone to be increased. It also permits a decrease of the rate at which a conventional quench recycle stream can be introduced into the vacuum separation zone.

SUMMARY OF THE INVENTION

In accordance with the invention there is provided, in a process for separating a fluid hydrocarbonaceous mixture comprising the steps of: (a) introducing said hydrocarbonaceous mixture into an atmospheric distillation zone to separate said oil into fractions, including a heavy bottoms fraction; (b) passing at least a portion of said heavy bottoms fraction to a heating zone; (c) introducing the resulting heated portion of said heavy bottom fraction into a separation zone maintained under vacuum to produce fractions, including a vacuum residuum fraction; (d) recycling at least a portion of said vacuum residuum to said vacuum separation zone; the improvement which comprises: (e) passing directly as a separate stream at least a portion of said heavy bottoms fraction of step (a) from said atmospheric distillation zone to said vacuum separation zone.

BRIEF DESCRIPTION OF THE DRAWING

The FIGURE is a schematic flow plan of one embodiment of the invention.

DESCRIPTION OF THE PREFERRED EMBODIMENT

Referring to the Figure, a fluid hydrocarbonaceous mixture is passed by line 10 into atmospheric distillation zone 1 operated at conventional conditions. Preferably, the hydrocarbonaceous mixture is a hydrocarbonaceous oil. The hydrocarbonaceous oil may be a virgin hydrocarbonaceous oil or a hydrocarbonaceous oil product resulting from a hydrocarbon conversion process. The hydrocarbonaceous oil carried by line 10 may be derived from any source, such as petroleum, tarsand oil, shale oil, liquids derived from coal liquefaction processes and mixtures thereof. These hydrocarbonaceous oils may contain contaminants, such as sulfur and/or nitrogen compounds and may also contain metallic contaminants. All boiling points referred to herein are atmospheric pressure boiling points unless otherwise specified. In atmospheric distillation zone 1, the hydrocarbonaceous oil feed is separated into fractions having different boiling point ranges, such as a vapor phase fraction which includes normally liquid hydrocarbons, removed by line 12, at least one intermediate boiling range fraction removed by line 14. By the term "normally liquid" with reference to "hydrocarbons" is intended herein hydrocarbons that are liquid at standard temperature and pressure conditions. Additional sidestream fractions (not shown) may be removed from distillation zone 1. The heavy bottoms fraction (i.e. atmospheric residuum) is passed by line 16 into pump 2. Subsequently, in accordance with the present invention, the heavy bottoms fraction of line 16 is split into a first portion and into a second portion. The first portion is passed into heating zone 3 such as, a furnace. The first heavy bottoms portion of line 16, into which steam is introduced by line 17, is introduced into heating zone 3 at a rate ranging from about 10 to about 100 thousand barrels per day (kB/D). The second portion is removed from line 16 and introduced as a separate stream by line 18 into vacuum separation zone 4 (e.g. a vacuum distillation column) comprising a stripping zone in its lower portion and a flash zone positioned above the stripping zone. Preferably, stream 18 is passed to the lower portion of the vacuum separation zone 4 in which is positioned the stripping zone. The heavy bottoms fraction of line 16 is, desirably, split such that at least about 5 to 10% by weight or by volume of the heavy bottoms stream 16 is introduced directly into vacuum separation zone 4. The first portion of line 16, after being heated, is removed from heating zone 3 by line 20 at a temperature ranging from about 700 to about 850 degrees F. and passed into vacuum separation zone 4. Preferably, the heated bottoms fraction is introduced into the flash zone of vacuum separation zone 4. The heavy bottoms fraction of atmospheric distillation zone 1 (streams 16 and 18) introduced into vacuum separation zone 4 are separated under vacuum into at least a vapor phase fraction removed by line 24, an intermediate boiling range fraction removed by line 26, and a heavy bottoms fraction (i.e. vacuum residuum) removed by line 28. The vacuum separation zone 4 is operated at conventional temperature conditions. The heavy bottoms fraction removed by line 28 is passed through a pump 5 and, thereafter to heat exchange zone 6 to cool stream 28 by heat exchange. The cooled stream is split into a first portion removed by line 30 and a second portion. The cooled second portion is recycled by line 32 as a quench into a lower portion of vacuum separation zone 4. The rate of introduction of quench stream 32 into vacuum separation zone 4 may, suitably, range from about 5 to about 15 kB/D. The rate of introduction of heated stream 20 into vacuum separation zone 4 may, suitably, range from about 9 to about 90 kB/D. A stripping gas such as steam is introduced into vacuum separation zone 4 by line 22.

The following prophetic Examples 1 and 2 of the invention and Comparative Example A, all of which are paper examples, are presented to illustrate the invention. The examples were calculated by using a distillation computer program.

A vacuum distillation column was simulated by a tray-to-tray computer program. Total steam rate to the column is the same for all these examples; however, the steam rate to the bottom stripper of the vacuum distillation zone is increased (at the expense of coil steam) in Examples 1 and 2.

COMPARATIVE EXAMPLE A

A conventional vacuum pipestill configuration is simulated as Comparative Example A (base case). An overhead product, two sidestreams and a bottoms product are withdrawn from a vacuum distillation tower. The material balance and operating conditions are shown in the Table. The quenching stream rate is maintained to keep the bottoms product pump suction temperature below 700 degrees F.

EXAMPLE 1

An atmospheric residuum (i.e. vacuum tower feed stream) is split into two streams. The major portion of the atmospheric residuum (95%) is passed to a vacuum furnace while a minor portion of the atmospheric residuum (5%) is introduced into the stripping zone of the vacuum distillation tower. This minor portion "quenches" (cools) the stripping zone and permits decreasing the rate of the recycling quench stream from 29% to 19.5% (per bottom product).

EXAMPLE 2

The number of the theoretical stages in the stripping zone of the vacuum distillation tower is increased to 2 (versus 1 stage of Comparative Example A and of Example 1). As can be seen from the Table, Example 2 shows an improvement over Example 1 (recycling quench rate equals 18%), and an improvement in the initial boiling point (IBP).

TABLE

| | Comparative Example A | Example 1 | Example 2 |
|---|---|---|---|
| Feed Rate % | | | |
| Through Furnace | 100 | 95 | 95 |
| To Bottom Stripping Zone of vacuum tower | 0 | 5 | 5 |
| Product Rate, % Per Feed | | | |
| Overhead | 2 | 2 | 2 |
| SS1 | 27 | 27 | 27 |
| SS2 | 27 | 27 | 27 |
| Bottoms | 44 | 44 | 44 |
| Steam Rate to Bottom of vacuum tower | | | |
| lb/gal of Bottom Product | 0.186 | 0.267 | 0.267 |
| % Of Total Steam (Furnace Coil Steam & Bottom Stripper Steam) | 36 | 52 | 52 |
| Total Steam Rate, % of Base Case | 100 | 100 | 100 |
| Number of Theoretical Stages in Bottom Stripper | 1 | 1 | 2 |
| Vacuum Tower Bottom Tray Temperature, °F. | 758 | 739 | 736 |
| Quench Rate, % per Bottom Product | 29 | 19.5 | 18 |
| IBP of Bottoms, °F. | 916 | 867 | 917 |

Footnotes:
SS1 = sidestream 1
SS2 = sidestream 2
IBP = initial boiling point

What is claimed is:

1. In a process for separating a fluid hydrocarbonaceous mixture comprising the steps of:

(a) introducing said hydrocarbonaceous mixture into an atmospheric distillation zone to separate said oil into fractions, including a heavy bottoms fraction;

(b) passing at least a portion of said heavy bottoms fraction to a heating zone;

(c) introducing the resulting heated portion of said heavy bottoms fractions to a separation zone maintained under vacuum to produce fractions, including a vacuum residuum fraction;

(d) recycling at least a portion of said vacuum residuum fraction to said vacuum separation zone;

the improvement which comprises:

(e) passing directly as a separate stream at least a portion of said heavy bottoms fraction of step (a) from said atmospheric distillation zone to the bottom stripping part of said vacuum separation zone.

2. The process of claim 1, wherein said vacuum separation zone comprises a stripping zone and wherein said portion of heavy bottoms fraction is passed, in step (e) to said stripping zone.

3. The process of claim 1, wherein said vacuum separation zone comprises a flash zone positioned above a stripping zone, and wherein said heated heavy bottoms portion of step (c) is passed from said heating zone to said flash zone.

4. The process of claim 1, wherein said bottoms portion of step (b) is introduced into said heating zone at a rate ranging from about 10 to about 100 thousand barrels per day.

5. The process of claim 1, wherein said vacuum residuum portion of step (d) is recycled to said vacuum separation zone at a rate ranging from about 5 to about 15 thousand barrels per day.

6. The process of claim 1, wherein, in step (c), said heated heavy bottoms portion is introduced into said vacuum separation zone at a temperature ranging from about 700 to about 850 degrees F.

7. The process of claim 1, wherein, in step (c), said heated heavy bottoms portion is introduced into said vacuum separation zone at a rate ranging from about 9 to about 90 thousand barrels per day.

8. The process of claim 1, wherein said portion of heavy bottoms fraction of step (e) passed directly to said vacuum separation zone comprises from about 5 to about 10 percent of the total heavy bottoms fraction of said atmospheric distillation zone being introduced into said vacuum separation zone.

9. The process of claim 1, wherein said vacuum separation zone comprises a vacuum distillation zone.

10. The process of claim 1 wherein said hydrocarbonaceous mixture of step (a) is a hydrocarbonaceous oil.

* * * * *